US011395510B2

(12) United States Patent
Conner et al.

(10) Patent No.: US 11,395,510 B2
(45) Date of Patent: Jul. 26, 2022

(54) AEROSOL DELIVERY DEVICE WITH ROTATABLE ENCLOSURE FOR CARTRIDGE

(71) Applicant: R.J. Reynolds Tobacco Company, Winston-Salem, NC (US)

(72) Inventors: Billy T. Conner, Clemmons, NC (US); Thaddeus Jackson, Summerfield, NC (US); Edmond Strother Smith, III, Rural Hall, NC (US); Taylor Leigh, Alpharetta, GA (US); Randall Bachtel, Lawrenceville, GA (US); Frank Bascas, Montezuma, GA (US); Hannah Tam, San Francisco, CA (US); Moises Araya, Atlanta, GA (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 281 days.

(21) Appl. No.: 16/516,821

(22) Filed: Jul. 19, 2019

(65) Prior Publication Data

US 2021/0015176 A1 Jan. 21, 2021

(51) Int. Cl.
*A24F 7/00* (2006.01)

(52) U.S. Cl.
CPC ..... *A24F 7/00* (2013.01)

(58) Field of Classification Search
None
See application file for complete search history.

(56) References Cited

U.S. PATENT DOCUMENTS 1,388,222 A * 8/1921 Vakilian ..... A24F 13/14 131/175
1,464,300 A 8/1923 Taff
(Continued)

FOREIGN PATENT DOCUMENTS

JP 2002034543 A 2/2002
WO WO1995034226 12/1995
(Continued)

OTHER PUBLICATIONS

International Search Report from the corresponding International Application No. PCT/IB2020/056772, dated Oct. 2, 2020.
(Continued)

*Primary Examiner* — Timothy Kennedy
*Assistant Examiner* — Guy F Mongelli
(74) *Attorney, Agent, or Firm* — Womble Bond Dickinson (US) LLP

(57) ABSTRACT

The present disclosure is directed to an aerosol delivery device and a holder for use with a removable substrate cartridge. In one implementation, the holder may include a main body having a mouthend and a rotating end portion. The main body may define a receiving compartment configured to receive at least a portion of the cartridge proximate a distal end of the main body. The main body may further define an aerosol passage extending from the receiving portion through the mouthend. The rotating end portion may be configured to rotate to and from an open position, in which the rotating end portion is turned outward so as to provide access to the receiving compartment, and a use position, in which the rotating end portion is turned inward so as to cover the heat source of an inserted cartridge.

20 Claims, 8 Drawing Sheets

(56) References Cited

U.S. PATENT DOCUMENTS 1,505,655 A 8/1924 Marek
1,541,891 A 6/1925 Becker
1,607,132 A 11/1926 Kuno
1,613,545 A 1/1927 Teigen
1,941,531 A 1/1934 Blankenship
2,008,433 A 7/1935 Ashour
2,373,629 A 4/1945 Kilgore
2,455,492 A 12/1948 Jackson
2,502,831 A 4/1950 Daze
2,541,837 A 2/1951 Schroff
2,701,571 A 2/1955 Dittrich
2,711,176 A 6/1955 Vakilian
2,779,340 A 1/1957 Mansfield
2,953,136 A 9/1960 Dahly
3,155,099 A 11/1964 Minchin
3,181,538 A 5/1965 Piliego
3,685,520 A 8/1972 Chernack
4,708,151 A 11/1987 Shelar
4,714,082 A 12/1987 Banerjee et al.
4,966,171 A 10/1990 Serrano et al.
4,991,606 A 2/1991 Serrano et al.
5,040,552 A 8/1991 Schleich et al.
5,060,676 A 10/1991 Hearn et al.
5,076,296 A 12/1991 Nystrom et al.
5,159,940 A 11/1992 Hayward et al.
5,178,165 A 1/1993 DeFelice
5,240,012 A 8/1993 Ehrman et al.
5,592,955 A 1/1997 Keritsis
5,595,577 A 1/1997 Bensalem et al.
5,692,525 A 12/1997 Counts et al.
5,845,649 A 12/1998 Saito et al.
6,006,757 A 12/1999 Lichtenberg
6,053,176 A 4/2000 Adams et al.
6,164,287 A 12/2000 White
6,311,694 B1 11/2001 Nichols et al.
6,345,625 B1 2/2002 Chew
6,371,127 B1 4/2002 Snaidr et al.
6,431,177 B1 8/2002 Sieggen et al.
6,532,965 B1 3/2003 Abhulimen et al.
6,615,843 B2 9/2003 Pera
6,748,955 B2 6/2004 Snaidr et al.
7,080,649 B2 7/2006 Hcu
7,503,330 B2 3/2009 Borschke et al.
7,600,517 B1 10/2009 Holzrichter
7,624,739 B2 12/2009 Snaidr et al.
8,061,361 B2 11/2011 Maeder et al.
8,151,803 B2 4/2012 Inagaki
8,302,611 B2 11/2012 Rowley
8,528,567 B2 9/2013 Hajaligol
8,616,217 B2 12/2013 Tsurizumi et al.
8,776,803 B2 7/2014 Tarora et al.
8,863,754 B2 10/2014 Renaud et al.
8,915,255 B2 12/2014 Poget et al.
9,078,473 B2 7/2015 Worm et al.
9,149,072 B2 10/2015 Conner et al.
9,220,301 B2 12/2015 Banerjee et al.
9,282,769 B2 3/2016 Mishra et al.
9,301,546 B2 4/2016 Thomas et al.
9,332,784 B2 5/2016 Banerjee et al.
9,439,453 B2 9/2016 Conner et al.
9,532,591 B2 1/2017 Mironov
9,549,572 B2 1/2017 Dincer et al.
9,609,893 B2 4/2017 Novak, III et al.
9,629,393 B2 4/2017 Stolz et al.
9,693,587 B2 7/2017 Plojoux
9,717,273 B2 8/2017 Poget et al.
9,730,468 B2 8/2017 Poget et al.
9,801,412 B2 10/2017 Grant
9,894,930 B2 2/2018 Bonici et al.
9,918,494 B2 3/2018 Mironov et al.
9,930,915 B2 4/2018 Worm et al.
9,943,114 B2 4/2018 Batista
9,961,939 B2 5/2018 Reevell
10,034,493 B2 7/2018 Akiyama et al.
10,064,428 B2 9/2018 Swepston et al.
10,064,478 B2 9/2018 Brooks
10,111,463 B2 10/2018 Batista
10,159,277 B2 12/2018 Bonnely
10,212,968 B2 2/2019 Mironov et al.
10,398,168 B2 9/2019 Maiwald et al.
10,470,491 B2 11/2019 Sutton et al.
10,492,526 B2 12/2019 Sampson et al.
10,524,503 B2 1/2020 Florack et al.
10,827,780 B2 11/2020 Swepston et al.
2002/0100487 A1* 8/2002 St. Charles ..... A24F 42/10 131/185
2008/0047570 A1 2/2008 Plank
2008/0092912 A1 4/2008 Robinson et al.
2009/0065011 A1 3/2009 Maeder et al.
2011/0083674 A1 4/2011 Karpinsky
2013/0133675 A1 5/2013 Shinozaki et al.
2013/0167850 A1 7/2013 Al-Aawar
2013/0228190 A1 9/2013 Weiss et al.
2014/0048085 A1 2/2014 Cox
2015/0034100 A1 2/2015 Park et al.
2015/0040924 A1 2/2015 Mironov et al.
2015/0245667 A1* 9/2015 Memari ..... A24F 40/95 131/329
2015/0296882 A1 10/2015 Mironov et al.
2015/0342254 A1 12/2015 Mironov et al.
2016/0007648 A1 1/2016 Sutton et al.
2016/0007649 A1 1/2016 Sampson et al.
2016/0120216 A1 5/2016 Mironov et al.
2016/0135495 A1 5/2016 Poget et al.
2016/0174609 A1 6/2016 Mironov
2016/0192704 A1 7/2016 Bonnely
2016/0316816 A1 11/2016 Lavanchy et al.
2016/0360785 A1 12/2016 Bless et al.
2017/0000189 A1 1/2017 Mironov et al.
2017/0027228 A1 2/2017 Rastogi
2017/0055577 A1 3/2017 Batista
2017/0055578 A1 3/2017 Oda et al.
2017/0164654 A1 6/2017 Ademe
2017/0196261 A1 7/2017 Borges De Couraca et al.
2017/0303585 A1 10/2017 Florack et al.
2017/0318859 A1 11/2017 Batista
2018/0000165 A1 1/2018 Liu
2018/0014571 A1 1/2018 Nakano
2018/0020737 A1* 1/2018 Mironov ..... H05B 3/44 131/329
2018/0070640 A1 3/2018 Bessant et al.
2018/0116280 A1 5/2018 Maiwald et al.
2018/0192707 A1 7/2018 Worm et al.
2018/0317560 A1 11/2018 Shinozaki et al.
2018/0325167 A1 11/2018 Grant
2018/0368468 A1 12/2018 Mishra et al.
2019/0000135 A1 1/2019 Lavanant et al.
2019/0000141 A1 1/2019 Rojo-Calderon et al.
2019/0000142 A1 1/2019 Lavanchy et al.
2019/0014818 A1 1/2019 Saygili
2019/0014820 A1 1/2019 Malgat
2019/0014821 A1 1/2019 Batista et al.
2019/0059449 A1 2/2019 Akiyama et al.
2019/0059450 A1 2/2019 Akiyama et al.
2019/0075848 A1 3/2019 Worm et al.
2019/0124972 A1 5/2019 Nakano
2019/0124973 A1 5/2019 Nakano et al.
2019/0133176 A1 5/2019 Nakano et al.
2019/0150505 A1 5/2019 Ceppi et al.
2019/0274358 A1 9/2019 Reevell
2020/0015519 A1 1/2020 Conner et al.
2020/0060333 A1 2/2020 Sutton et al.
2020/0146349 A1 5/2020 Phillips et al.
2020/0268044 A1 8/2020 Wilson
2020/0288780 A1* 9/2020 Martin ..... A24F 40/20
2021/0015172 A1 1/2021 Conner et al.
2021/0015174 A1 1/2021 Cox et al.
2021/0015175 A1 1/2021 Jackson et al.

FOREIGN PATENT DOCUMENTS

WO WO1998054989 12/1998
WO WO2009022232 2/2009
WO WO2013072336 5/2013

(56) References Cited

FOREIGN PATENT DOCUMENTS

| | | | |
|---|---|---|---|
| WO | 2013083963 | A1 | 6/2013 |
| WO | WO2013149810 | | 10/2013 |
| WO | WO2013189836 | | 12/2013 |
| WO | WO2014037270 | | 3/2014 |
| WO | WO2014156838 | | 10/2014 |
| WO | 2014180893 | A1 | 11/2014 |
| WO | WO2015097005 | | 7/2015 |
| WO | 2015/117703 | A1 | 8/2015 |
| WO | WO2015128384 | | 9/2015 |
| WO | WO2015151158 | | 10/2015 |
| WO | WO2015184744 | | 12/2015 |
| WO | WO2015197850 | | 12/2015 |
| WO | WO2017042297 | | 3/2017 |
| WO | WO2017108912 | | 6/2017 |
| WO | WO2017114760 | | 7/2017 |
| WO | WO2017115181 | | 7/2017 |
| WO | WO2017115182 | | 7/2017 |
| WO | WO2017115183 | | 7/2017 |
| WO | WO2017115184 | | 7/2017 |
| WO | WO2017115185 | | 7/2017 |
| WO | WO2017115188 | | 7/2017 |
| WO | WO2017115196 | | 7/2017 |
| WO | WO2017207442 | | 12/2017 |
| WO | WO2017212284 | | 12/2017 |
| WO | WO2018170800 | | 9/2018 |
| WO | WO2018201655 | | 11/2018 |
| WO | 2019/016740 | A1 | 1/2019 |
| WO | WO2019010680 | | 1/2019 |
| WO | 2020216762 | A1 | 10/2020 |

OTHER PUBLICATIONS

Stephenson, "A 'Safer' Cigarette? Prove It, Say Critics", JAMA, 2000, 283(19), pp. 2507-2508. doi:10.1001/jama.283.19.2507.

"Chemical and Biological Studies on New Cigarette Prototypes That Heat Instead of Burn Tobacco", R. J. Reynolds Tobacco Company, 1988.

* cited by examiner

AEROSOL DELIVERY DEVICE WITH ROTATABLE ENCLOSURE FOR CARTRIDGE

FIELD OF THE DISCLOSURE

The present disclosure relates to aerosol delivery devices and systems, such as smoking articles; and more particularly, to aerosol delivery devices and systems that utilize heat sources, such as combustible carbon-based ignition sources, for the production of aerosol (e.g., smoking articles for purposes of yielding components of tobacco, tobacco extracts, nicotine, synthetic nicotine, non-nicotine flavoring, and other materials in an inhalable form, commonly referred to as heat-not-burn systems or electronic cigarettes). Components of such articles may be made or derived from tobacco, or those articles may be characterized as otherwise incorporating tobacco for human consumption, and which may be capable of vaporizing components of tobacco and/or other tobacco related materials to form an inhalable aerosol for human consumption.

BACKGROUND

Many smoking articles have been proposed through the years as improvements upon, or alternatives to, smoking products based upon combusting tobacco. Example alternatives have included devices wherein a solid or liquid fuel is combusted to transfer heat to tobacco or wherein a chemical reaction is used to provide such heat source. Examples include the smoking articles described in U.S. Pat. No. 9,078,473 to Worm et al., which is incorporated herein by reference.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers which utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al.; and U.S. Pat. App. Pub. Nos. 2013/0255702 to Griffith, Jr. et al.; and 2014/0096781 to Sears et al., which are incorporated herein by reference. See also, for example, the various types of smoking articles, aerosol delivery devices and electrically powered heat generating sources referenced by brand name and commercial source in U.S. Pat. App. Pub. No. 2015/0220232 to Bless et al., which is incorporated herein by reference. Additional types of smoking articles, aerosol delivery devices and electrically powered heat generating sources referenced by brand name and commercial source are listed in U.S. Pat. App. Pub. No. 2015/0245659 to DePiano et al., which is also incorporated herein by reference in its entirety. Other representative cigarettes or smoking articles that have been described and, in some instances, been made commercially available include those described in U.S. Pat. No. 4,735,217 to Gerth et al.; U.S. Pat. Nos. 4,922,901, 4,947,874, and 4,947,875 to Brooks et al.; U.S. Pat. No. 5,060,671 to Counts et al.; U.S. Pat. No. 5,249,586 to Morgan et al.; U.S. Pat. No. 5,388,594 to Counts et al.; U.S. Pat. No. 5,666,977 to Higgins et al.; U.S. Pat. No. 6,053,176 to Adams et al.; U.S. Pat. No. 6,164,287 to White; U.S. Pat No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,726,320 to Robinson et al.; U.S. Pat. No. 7,896,006 to Hamano; U.S. Pat. No. 6,772,756 to Shayan; U.S. Pat. App. Pub. No. 2009/0095311 to Hon; U.S. Pat. App. Pub. Nos. 2006/0196518, 2009/0126745, and 2009/0188490 to Hon; U.S. Pat. App. Pub. No. 2009/0272379 to Thorens et al.; U.S. Pat. App. Pub. Nos. 2009/0260641 and 2009/0260642 to Monsees et al.; U.S. Pat. App. Pub. Nos. 2008/0149118 and 2010/0024834 to Oglesby et al.; U.S. Pat. App. Pub. No. 2010/0307518 to Wang; and WO 2010/091593 to Hon, which are incorporated herein by reference.

Various manners and methods for assembling smoking articles that possess a plurality of sequentially arranged segmented components have been proposed. See, for example, the various types of assembly techniques and methodologies set forth in U.S. Pat. No. 5,469,871 to Barnes et al. and U.S. Pat. No. 7,647,932 to Crooks et al.; and U.S. Pat. App. Pub. Nos. 2010/0186757 to Crooks et al.; 2012/0042885 to Stone et al., and 2012/00673620 to Conner et al.; each of which is incorporated by reference herein in its entirety.

Certain types of cigarettes that employ carbonaceous fuel elements have been commercially marketed under the brand names "Premier," "Eclipse" and "Revo" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). Additionally, a similar type of cigarette has been marketed in Japan by Japan Tobacco Inc. under the brand name "Steam Hot One."

In some instances, some smoking articles, particularly those that employ a traditional paper wrapping material, are also prone to scorching of the paper wrapping material overlying an ignitable fuel source, due to the high temperature attained by the fuel source in proximity to the paper wrapping material. This can reduce enjoyment of the smoking experience for some consumers and can mask or undesirably alter the flavors delivered to the consumer by the aerosol delivery components of the smoking articles. In further instances, traditional types of smoking articles can produce relatively significant levels of gasses, such as carbon monoxide and/or carbon dioxide, during use (e.g., as products of carbon combustion). In still further instances, traditional types of smoking articles may suffer from poor performance with respect to aerosolizing the aerosol forming component(s).

As such, it would be desirable to provide smoking articles that address one or more of the technical problems sometimes associated with traditional types of smoking articles. In particular, it would be desirable to provide a smoking article that is easy to use and that provides reusable and/or replaceable components.

BRIEF SUMMARY

The present disclosure relates to aerosol delivery devices and holders for use with removable and replaceable cartridges. In one implementation, the present disclosure provides an aerosol delivery device that may comprise a holder comprising a main body having a mouthend and a rotating end portion, a removable cartridge comprising a heat portion including a heat source configured to generate heat, and a substrate portion disposed proximate the heat source, the substrate portion comprising a substrate material including an aerosol precursor composition. The main body may define a receiving compartment configured to receive at least a portion of the cartridge proximate a distal end of the main body, the main body may further define an aerosol passage extending from the receiving compartment through the mouthend, and the rotating end portion may be configured to rotate to and from an open position, in which the rotating end portion is turned outward so as to provide access to the receiving compartment, and a use position, in which the rotating end portion is turned inward so as to cover the heat source of an inserted cartridge.

In some implementations, the rotating end portion may comprise a single end cover. In some implementations, the rotating end portion may comprise first and second opposing end covers. In some implementations, the first and second opposing end covers may define respective distal ends, and in the open position the distal ends of the first and second end covers may be configured to be rotated outward and away from each other, and in the use position the distal ends of the first and second end covers may be configured to be rotated inward and proximate each other. In some implementations, the holder may further comprise an actuating mechanism configured to rotate the rotating end portion. In some implementations, the actuating mechanism may be configured to rotate the rotating end portion from the use position to the open position. In some implementations, the actuating mechanism may be configured to rotate the rotating end portion from the open position to the use position. In some implementations, the actuating mechanism may include one or more buttons located on the main body of the device. In some implementations, the mouthend may comprise a separate mouthpiece configured to be insertable into the main body. In some implementations, the mouthend may comprise a separate mouthpiece, the main body may be configured to be insertable into the mouthpiece, and the mouthpiece may include a collapsible portion configured to lock the mouthpiece and the main body together.

In another implementation, the present disclosure provides a holder for use with a removable and replaceable substrate cartridge. The holder may comprise a main body having a mouthend, and a rotating end portion. The main body may define a receiving compartment configured to receive at least a portion of the cartridge proximate a distal end of the main body, the main body may further define an aerosol passage extending from the receiving compartment through the mouthend, and the rotating end portion may be configured to rotate to and from an open position, in which the rotating end portion is turned outward so as to provide access to the receiving compartment, and a use position, in which the rotating end portion is turned inward so as to cover the heat source of an inserted cartridge.

In some implementations, the rotating end portion may comprise a single end cover. In some implementations, the rotating end portion may comprise first and second opposing end covers. In some implementations, the first and second opposing end covers may define respective distal ends, and in the open position the distal ends of the first and second end covers may be configured to be rotated outward and away from each other, and in the use position the distal ends of the first and second end covers may be configured to be rotated inward and proximate each other. Some implementations may further comprise an actuating mechanism configured to rotate the rotating end portion. In some implementations, the actuating mechanism may be configured to rotate the rotating end portion from the use position to the open position. In some implementations, the actuating mechanism may be configured to rotate the rotating end portion from the open position to the use position. In some implementations, the actuating mechanism may include one or more buttons located on the main body of the device. In some implementations, the mouthend may comprise a separate mouthpiece configured to be insertable into the main body. In some implementations, the mouthend may comprise a separate mouthpiece, the main body may be configured to be insertable into the mouthpiece, and the mouthpiece may include a collapsible portion configured to lock the mouthpiece and the main body together.

These and other features, aspects, and advantages of the disclosure will be apparent from a reading of the following detailed description together with the accompanying drawings, which are briefly described below.

BRIEF DESCRIPTION OF THE DRAWINGS

Figure 1:
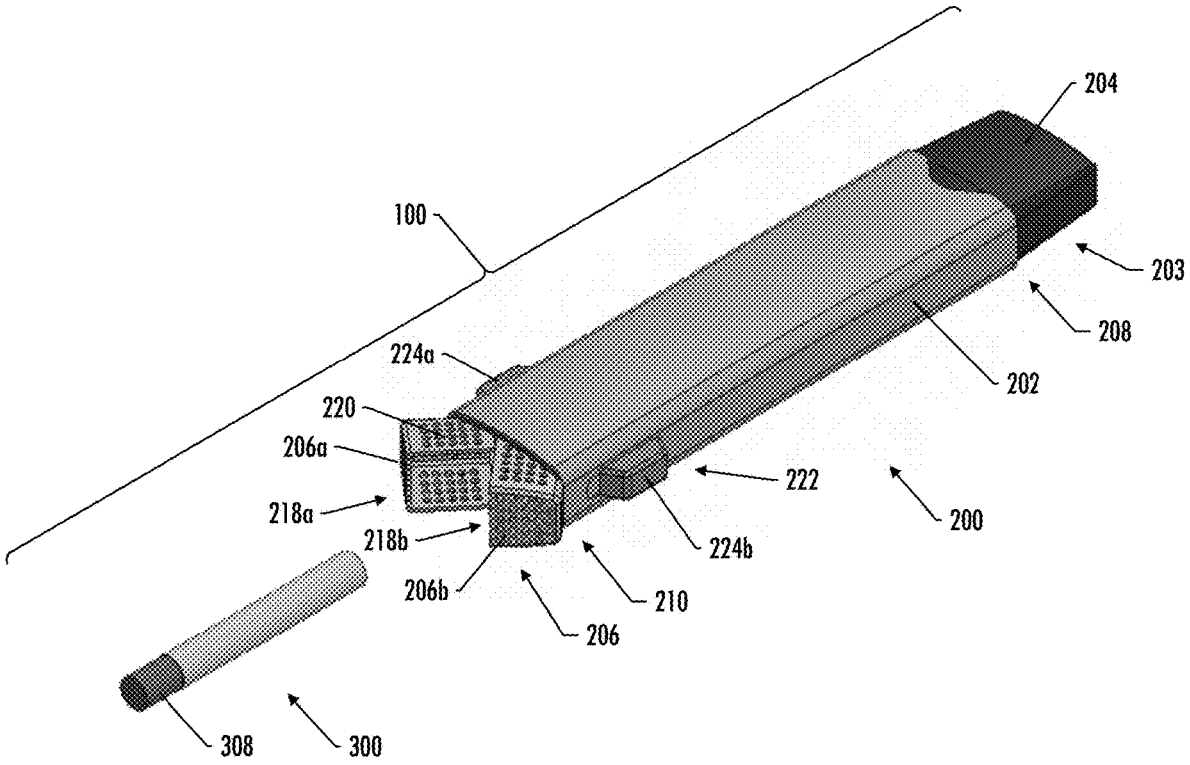
Figure 2:
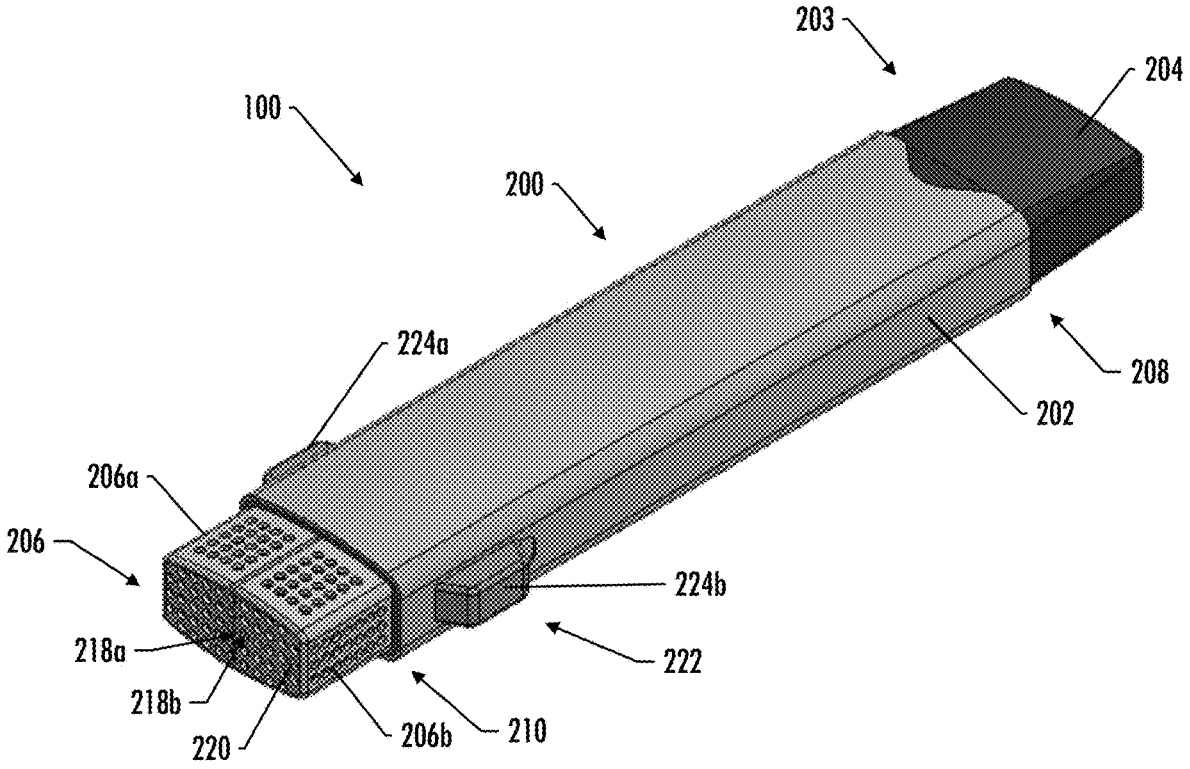
Figure 3:
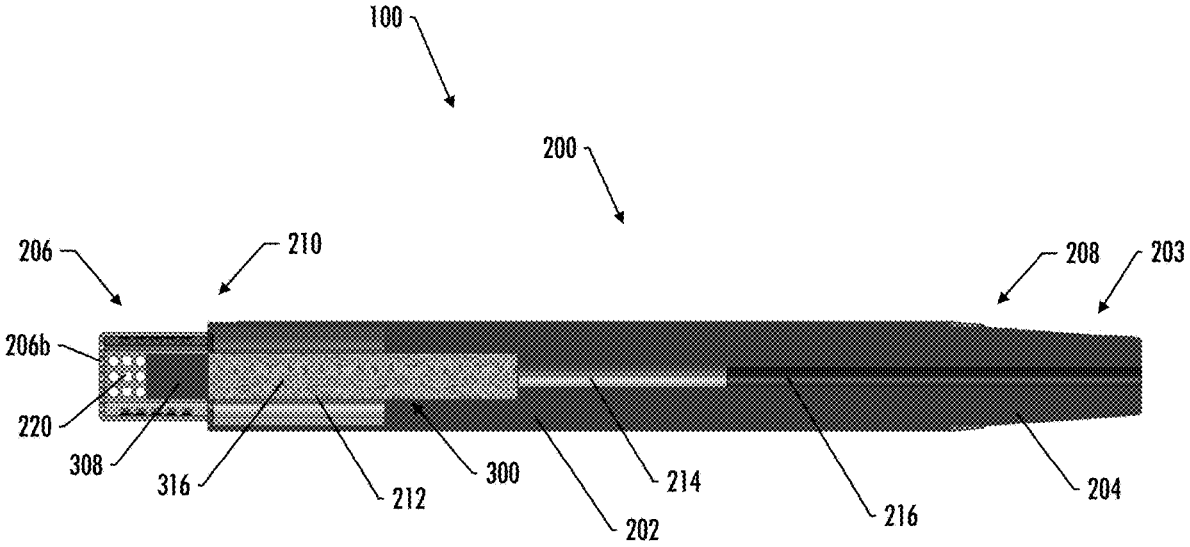
Figure 4:
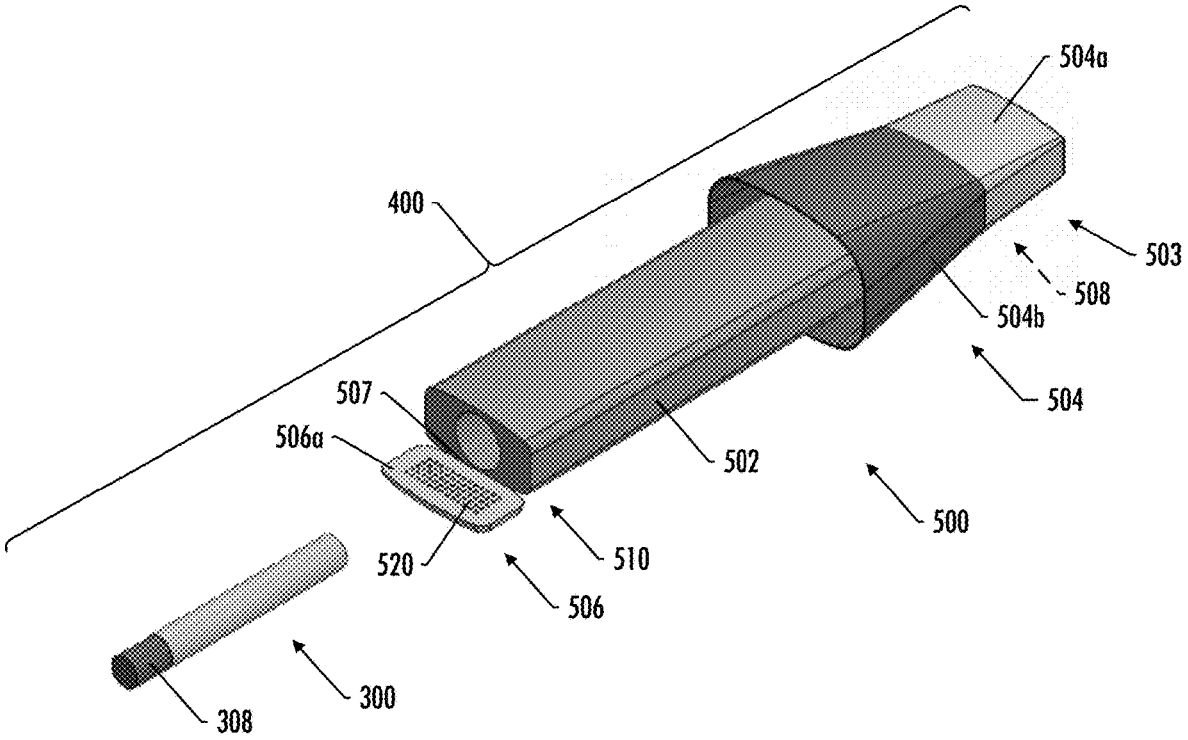
Figure 5:
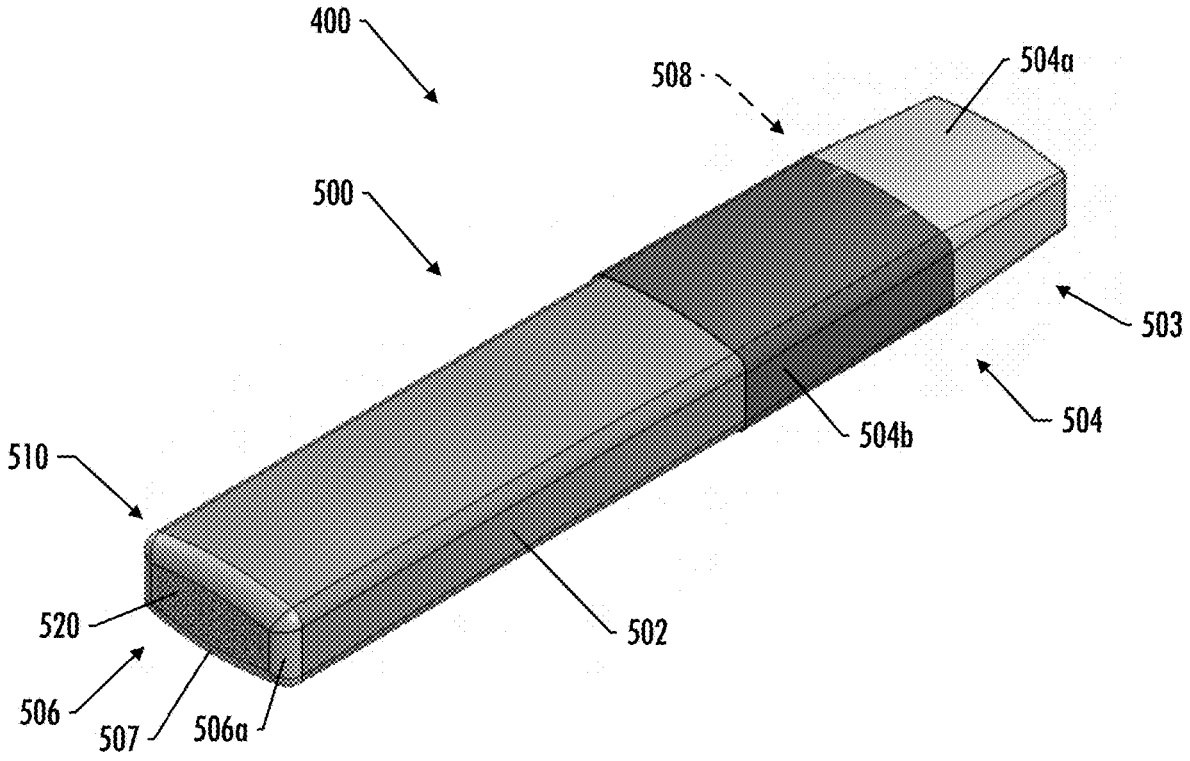
Figure 6:
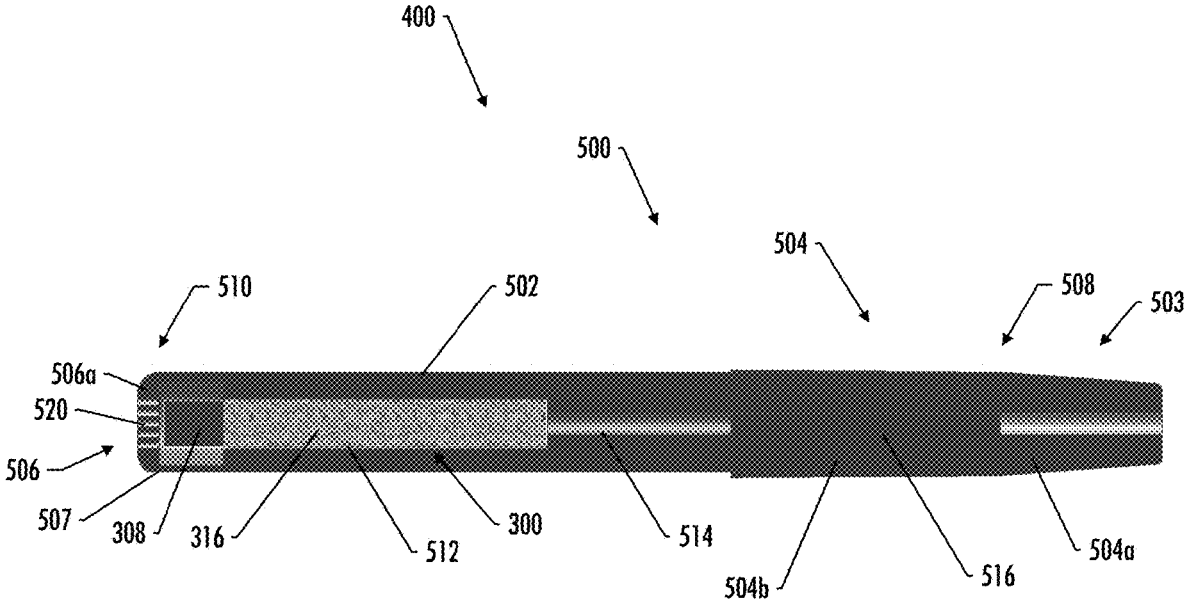
Figure 7:
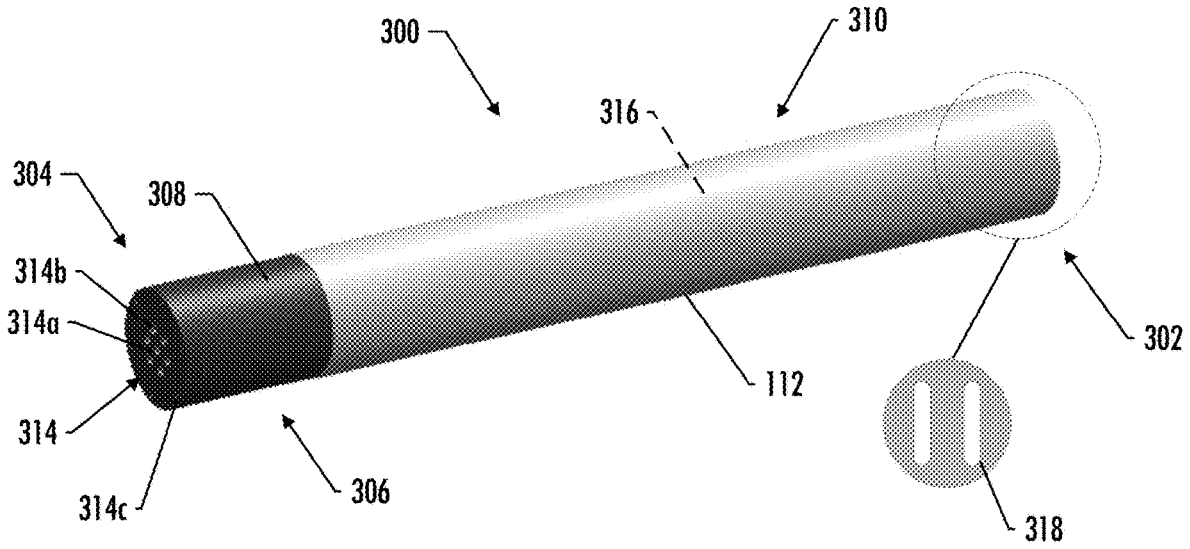
Figure 8:
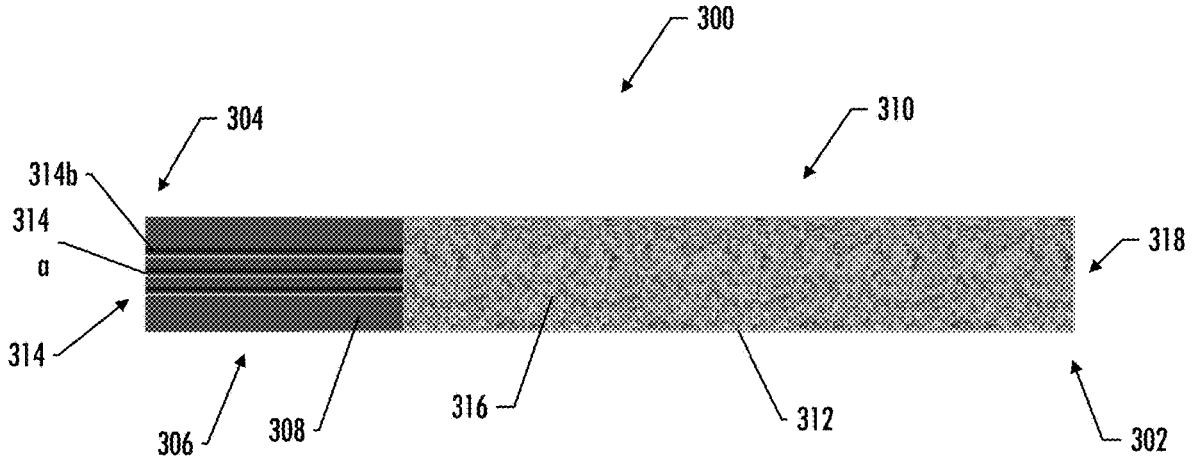

Having thus described the disclosure in the foregoing general terms, reference will now be made to the accompanying drawings, which are not necessarily drawn to scale, and wherein:

FIG. 1 illustrates a perspective view of an aerosol delivery device shown in an open position, according to one implementation of the present disclosure;

FIG. 2 illustrates a perspective view of a an aerosol delivery device shown in a use position, according to one implementation of the present disclosure;

FIG. 3 illustrates a longitudinal cross-section view of an aerosol delivery device shown in a use position, according to one implementation of the present disclosure;

FIG. 4 illustrates a perspective view of an aerosol delivery device shown in an open position, according to one implementation of the present disclosure;

FIG. 5 illustrates a perspective view of a an aerosol delivery device shown in a use position, according to one implementation of the present disclosure;

FIG. 6 illustrates a longitudinal cross-section view of an aerosol delivery device shown in a use position, according to one implementation of the present disclosure;

FIG. 7 illustrates a perspective view of a removable and replaceable cartridge, according to one implementation of the present disclosure; and FIG. 8 illustrates a longitudinal cross-section view of a removable and replaceable cartridge, according to one implementation of the present disclosure.

DETAILED DESCRIPTION

The present disclosure will now be described more fully hereinafter with reference to example embodiments thereof. These example embodiments are described so that this disclosure will be thorough and complete, and will fully convey the scope of the disclosure to those skilled in the art. Indeed, the disclosure is embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present disclosure provides descriptions of articles (and the assembly and/or manufacture thereof) in which a material is heated (preferably without combusting the material to any significant degree) to form an aerosol and/or an inhalable substance; such articles most preferably being sufficiently compact to be considered "hand-held" devices.

In preferred aspects, the articles are characterized as smoking articles. As used herein, the term "smoking article" is intended to mean an article and/or device that provides many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe, without any substantial degree of combustion of any component of that article and/or device. As used herein, the term "smoking article" does not necessarily mean that, in operation, the article or device produces smoke in the sense of an aerosol resulting from by-products of combustion or pyrolysis of tobacco, but rather, that the article or device yields vapors (including vapors within aerosols that are considered to be visible aerosols that might be considered to be described as smoke-like) resulting from volatilization or vaporization of certain components, elements, and/or the like of the article and/or device. In preferred aspects, articles or devices characterized as smoking articles incorporate tobacco and/or components derived from tobacco.

As noted, aerosol generating components of certain preferred aerosol delivery devices may provide many of the sensations (e.g., inhalation and exhalation rituals, types of tastes or flavors, organoleptic effects, physical feel, use rituals, visual cues such as those provided by visible aerosol, and the like) of smoking a cigarette, cigar or pipe that is employed by lighting and burning tobacco (and hence inhaling tobacco smoke), without any substantial degree of combustion of any component thereof. For example, the user of an aerosol delivery device in accordance with some example implementations of the present disclosure can hold and use that component much like a smoker employs a traditional type of smoking article, draw on one end of that piece for inhalation of aerosol produced by that piece, take or draw puffs at selected intervals of time, and the like.

Articles or devices of the present disclosure are also characterized as being vapor-producing articles, aerosol delivery articles, or medicament delivery articles. Thus, such articles or devices are adaptable so as to provide one or more substances in an inhalable form or state. For example, inhalable substances are substantially in the form of a vapor (e.g., a substance that is in the gas phase at a temperature lower than its critical point). Alternatively, inhalable substances are in the form of an aerosol (e.g., a suspension of fine solid particles or liquid droplets in a gas). For purposes of simplicity, the term "aerosol" as used herein is meant to include vapors, gases, and aerosols of a form or type suitable for human inhalation, whether or not visible, and whether or not of a form that might be considered to be smoke-like. In some implementations, the terms "vapor" and "aerosol" may be interchangeable. Thus, for simplicity, the terms "vapor" and "aerosol" as used to describe the disclosure are understood to be interchangeable unless stated otherwise.

In use, smoking articles of the present disclosure are subjected to many of the physical actions of an individual in using a traditional type of smoking article (e.g., a cigarette, cigar, or pipe that is employed by lighting with a flame and used by inhaling tobacco that is subsequently burned and/or combusted). For example, the user of a smoking article of the present disclosure holds that article much like a traditional type of smoking article, draws on one end of that article for inhalation of an aerosol produced by that article, and takes puffs at selected intervals of time.

While the systems are generally described herein in terms of implementations associated with smoking articles such as so-called "tobacco heating products," it should be understood that the mechanisms, components, features, and methods may be embodied in many different forms and associated with a variety of articles. For example, the description provided herein may be employed in conjunction with implementations of traditional smoking articles (e.g., cigarettes, cigars, pipes, etc.), heat-not-burn cigarettes, and related packaging for any of the products disclosed herein. Accordingly, it should be understood that the description of the mechanisms, components, features, and methods disclosed herein are discussed in terms of implementations relating to aerosol delivery devices by way of example only, and may be embodied and used in various other products and methods.

Smoking articles of the present disclosure generally include a number of elements provided or contained within an enclosure of some sort, such as a housing, an outer wrap, or wrapping, a casing, a component, a module, a member, or the like. The overall design of the enclosure is variable, and the format or configuration of the enclosure that defines the overall size and shape of the smoking article is also variable. In some, but not all implementations, the overall design, size, and/or shape of the enclosure resembles that of a conventional cigarette or cigar. Typically, an enclosure resembling the shape of a cigarette or cigar comprises separable components, members, or the like that are engaged to form the enclosure. For example, such a smoking article may comprise, in some aspects, separable components that include a holder and a cartridge that includes an aerosol delivery component (such as, for example, a substrate material) and a heat source component. In various aspects, the heat source may be capable of generating heat to aerosolize a substrate material that comprises, for example, an extruded structure and/or substrate, a substrate material associated with an aerosol precursor composition, tobacco and/or a tobacco related material, such as a material that is found naturally in tobacco that is isolated directly from the tobacco or synthetically prepared, in a solid or liquid form (e.g., beads, sheets, shreds, a wrap), or the like. In some implementations, an extruded structure may comprise tobacco products or a composite of tobacco with other materials such as, for example, ceramic powder. In other implementations, a tobacco extract/slurry may be loaded into porous ceramic beads. Other implementations may use non-tobacco products. In some implementations aerosol precursor composition-loaded porous beads/powders (ceramics) may be used. In other implementations, rods/cylinders made of extruded slurry of ceramic powder and aerosol precursor composition may be used.

According to certain aspects of the present disclosure, it may be advantageous to provide an aerosol delivery device that is easy to use and that provides reusable and/or replaceable components. FIGS. 1-3 illustrate an example implementation of such a device. In particular, FIG. 1 illustrates a perspective view of an aerosol delivery device 100 shown in an open position, according to an example implementation of the present disclosure; FIG. 2 illustrates a perspective view of the aerosol delivery device 100 shown in a use position, according to an example implementation of the present invention; and FIG. 3 illustrates a longitudinal cross-section view of the aerosol delivery device 100 shown in a use position, according to one implementation of the present disclosure.

As shown in the figures, the aerosol delivery device 100 of the depicted implementation includes a holder 200 and removable and replaceable cartridge 300 (described in more detail below with respect to FIGS. 7 and 8). In the depicted implementation, the holder 200 generally comprises a main body 202 having a mouthend 203, and a rotating end portion 206. Although in some implementations the mouthend of the holder may be integral with the main body, in the depicted implementation the mouthend of the holder comprises a separate mouthpiece 204, wherein the mouthpiece 204 is configured to be insertable into the main body 202. In other implementations, however, the main body may be configured to be insertable into the mouthpiece. In the depicted implementation, the mouthpiece 204 is configured to snap into the main body 202 (such as, for example, via one or more snap features located on the mouthpiece 204 and/or the main body 202). In other implementations, the mouthpiece may attach to the main body in a variety of other ways, including, for example, via a screw connection, a magnetic connection, or an interference fit. In still other implementations, the main body and the mouthpiece may comprise an integral component such that the mouthpiece comprises a portion of the main body. The main body 204 of the depicted implementation defines a first end 208 and an opposite distal end 210. In the depicted implementation, the main body 202 further includes a receiving compartment 212 (see FIG. 3) located proximate the distal end 210 of the main body 202, and which is configured to receive at least a portion of the cartridge 300. The main body 202 of the depicted implementation further includes an aerosol passage 214 extending from the receiving compartment 212 to the mouthpiece 204. In the depicted implementation, the mouthpiece 204 also includes an aerosol passage passage 216. As such, when the mouthpiece 204 of the depicted implementation is inserted into the main body 202, the aerosol passages 214, 216 substantially align.

In the depicted implementation, the holder 200 has a substantially rectangular shape, such as a substantially rectangular cuboid shape; however, in other implementations the holder may have a different shape. For example, in some implementations the holder may have a substantially cylindrical shape or a substantially oblong shape. In other implementations, the holder may have other hand-held shapes. For example, in some implementations the holder may have a small box shape, various pod mod shapes, or a fob-shape. In the depicted implementation, the holder 200 (when in a use position) has an overall length in an inclusive range of approximately 83 mm to approximately 120 mm, a width in the inclusive range of approximately 15 mm to approximately 25 mm, and a height in the inclusive range of approximately 8 mm to approximately 13 mm.

In various implementations, the holder, or various components or portions thereof (including, for example, the main body, the mouthpiece, and/or the rotating end portion), may be made of a variety of different materials. For example, in some implementations the holder (or one or more portions or components thereof) may be made of moldable plastic materials such as, for example, polycarbonate, polyethylene, acrylonitrile butadiene styrene (ABS), polyamide (Nylon), or polypropylene. In other implementations, however, the holder (or one or more portions or components thereof) may be made of a different material, such as, for example, a different plastic material, a metal material (such as, but not limited to, stainless steel, aluminum, brass, copper, silver, gold, or bronze), a graphite material, a glass material, a ceramic material, a natural material (such as, but not limited to, a wood material), a composite material, or any combinations thereof. In some implementations, the holder (or one or more portions or components thereof) may be made of the same material; however, in other implementations, the holder (or one or more portions or components thereof) may be made of different materials.

In various implementations of the present disclosure, the rotating end portion is configured to rotate to and from an open position, in which the rotating end portion is turned outward so as to provide access to the receiving compartment, and a use position, in which the rotating end portion is turned inward so as to cover (e.g., substantially fully cover) the heat source of an inserted cartridge. In the depicted implementation, for example, the rotating end portion 206 comprises two opposing end covers, a first end cover 206*a*, and a second end cover 206*b*. In depicted implementation, the first and second end covers 206*a*, 206*a* each define respective distal ends 218*a*, 218*b*. In the open position of the depicted implementation, the distal ends 218*a*, 218*b* are configured to be rotated outward and away from each other (see FIG. 1). In such a manner, a user may have access to insert into, and/or remove a cartridge from, the receiving compartment 212 of the main body 202. By contrast, in the use position (see FIG. 2) the distal ends 218*a*, 218*b* of the first and second end covers 206*a*, 206*b* are configured to be rotated inward and proximate each other. In such a manner, the cartridge 300, and in particular the heat source 308, is substantially covered by the first and second end covers 206*a*, 206*b* so as, for example, to protect the heat source 308 from accidental contact with a user.

In the depicted implementation, the rotating end portion 206 (and in particular, the first and second end covers 206*a*, 206*b* ) further includes a plurality of openings 220 defined through the end portion 206. In such a manner, the openings 220 may provide the heat source 308 of an inserted cartridge 300 with sufficient exposure to air to remain ignited in the use position. In depicted implementation, each of the first and second end covers 206*a*, 206*b* comprises a four-sided enclosure (e.g., a partial box-like shape) that includes a side wall, top and bottom walls, and an end wall. It should be noted that in other implementations, however, the first and second end covers may have other configurations, which may or may not include distinct sides, and which may or may not include one or more openings. In some implementations the first and second end covers may comprise rounded portions (e.g., each portion being a partially egg shaped or partially spherical shaped).

Although in some implementations one or more of the sides of the first and second end covers 206*a*, 206*b* may not include openings, in the depicted implementation the openings 220 are defined through each of the four sides of the end covers 206*a*, 206*b*. In the depicted implementation, the openings 220 have a substantially circular shape; however, in other implementations the openings may have any shape. As such, it will be appreciated that the rotating end portion can comprise fewer or additional openings and/or alternative shapes and sizes of openings than those illustrated.

In the depicted implementation, the holder 200 further includes an actuating mechanism 222, which is configured to rotate the rotating end portion 206 to or from an open position and a use position. In particular, in the depicted implementation the actuating mechanism includes first and second actuating buttons 224*a*, 224*b*, which are operatively connected to the first and second end covers 206*a*, 206*b*. In such a manner, the actuating buttons 224*a*, 224*b* of the depicted implementation are configured to rotate the end covers 206*a*, 206*b* to and/or from the open position and use position. In particular, the buttons 224*a*, 224*b* of the depicted implementation are configured to slide longitudinally along the main body 202 toward the mouthpiece 204 to actuate the end covers 206*a*, 206*b* into the open position. Likewise, the buttons 224*a*, 224*b* of the depicted implementation are configured to slide longitudinally along the main body 202 toward the distal end 210 of the main body 202 to actuate the end covers 206*a*, 206*b* into the use position. In various implementations, this actuation may be accomplished in a variety of ways, including, for example, via a four-bar linkage, via one or more levers, via a pulley system, via a slider-crank mechanism, via a spring mechanism, via a gear mechanism, via a cam follower mechanism, and/or any combinations thereof.

It should be noted that in other implementations, the sliding direction of the buttons may be reversed with respect to the open or use position of the end covers (e.g., the buttons may slide toward the mouthpiece to actuate the end covers into the use position, and the buttons may slide toward the distal end of the main body to actuate the end covers into the open position). In such a manner, in some implementations the buttons may be configured to slide along a path substantially parallel to an outer surface of the main body, while in other implementations the buttons may be configured to slide along a path substantially parallel to a longitudinal axis of the device (which may or may not be the same as a path substantially parallel to an outer surface of the main body). In other implementations, the buttons my comprise pushbuttons rather than sliding buttons. In such a manner, in some implementations the pushbuttons may move in a direction substantially perpendicular to an outer surface of the main body, while in other implementations the pushbuttons may move along a path substantially perpendicular to a longitudinal axis of the device (which may or may not be the same as a path substantially perpendicular to an outer surface of the main body). In still other implementations, the pushbuttons may move in a direction oblique to an outer surface of the main body or oblique to a longitudinal axis of the device. In other implementations, there may be a single button configured to effect actuation of the end covers. In yet other implementations, there need not be a button, but, rather, another device may effect actuation of the end covers, including, for example a rotating component (such as, for example, a rotating thumb knob). In still other implementations, the mouthpiece may serve as an actuating mechanism such that moving the mouthpiece (e.g., by sliding, twisting, and/or rotating) may effect actuation of the end covers. In further implementations, there need not be any actuating mechanism and the end covers may be rotated manually.

It should be noted that in other implementations, the aerosol delivery device of the present disclosure may include a third position, which may be an extinguishment position. In such a manner, the extinguishment position may be configured such that the heat source is deprived of sufficient oxygen to sustain combustion. In some implementations, the extinguishment position may be obtained by further rotating the rotating end portion. In other implementations, for example, one or more additional features may be included such that an extinguishment position may be achieved by actuating the one or more additional features. In particular, in one implementation the device may include an air impermeable cover feature located proximate the distal end of the sleeve that may be mechanically or manually actuatable (e.g., by rotating the cover feature over the end of the sleeve and/or by sliding the cover feature across the end of the sleeve) such that in the extinguishment position, the cover feature substantially covers the open end of the sleeve and the heat source is deprived of sufficient oxygen to sustain combustion In another implementation, the device may include a detachable feature, such as, for example an end cap, that may be used to achieve the extinguishment position. For example, in some implementations a separate end cap may be attachable over the distal end of the sleeve such that, once attached, the heat source is deprived of sufficient oxygen to sustain combustion. Such an end cap could also be used to cover the sleeve when not in use, such as, for example, to prevent dirt and/or foreign objects from entering into the device.

In the depicted implementation, ignition of the heat source 308 results in aerosolization of the aerosol precursor composition associated with the substrate material 316. In the depicted implementation, the aerosol passage 214 of the main body 202 and the aerosol passage 216 of the mouthpiece 204 are configured to receive the generated aerosol therethrough in response to a draw applied to the mouthpiece 204 by a user. Although not shown, in some implementations the main body may include one or more supplemental air inlet openings that extend through the main body proximate the receiving compartment. Additionally or alternatively, other implementations may include one or more supplemental air inlet openings that extend through the main body and/or mouthpiece downstream from the receiving compartment. In such a manner, drawn air may mix with the generated aerosol before being delivered to the user. In some implementations, the outer housing of the cartridge may include apertures that substantially align with the supplemental air inlet openings such that air is drawn through the substrate portion. In other implementations, the outer housing of the cartridge may have sufficient porosity such that is drawn through the substrate portion.

In some implementations the main body and/or the mouthpiece may include a filter configured to receive the aerosol therethrough in response to the draw applied to the holder. In various implementations, the filter may be provided, in some aspects, as a circular disc radially and/or longitudinally disposed proximate the end of the holder (such as, for example, proximate the mouthpiece) opposite the receiving end. In this manner, upon a draw on the holder, the filter may receive the aerosol flowing through holder of the aerosol delivery device. In some implementations, the filter may comprise discrete segments. For example, some implementations may include a segment providing filtering, a segment providing draw resistance, a hollow segment providing a space for the aerosol to cool, other filter segments, and any one or any combination of the above. Preferably, the elements of the substrate material do not experience thermal decomposition (e.g., charring, scorching, or burning) to any significant degree, and the aerosolized components are entrained in the air drawn through the smoking article, including a filter (if present), and into the mouth of the user. In some implementations, the mouthpiece may include a filter that may also provide a flavorant additive. In some implementations, a filter may include one or more filter segments that may be replaceable. For example, in some implementations one or more filter segments may be replaceable in order to customize a user's experience with the device, including, for example, filter segments that provide different draw resistances and/or different flavors. Some examples of flavor adding materials and/or components configured to add a flavorant can be found in U.S. patent application Ser. No. 16/408,942, filed on May 10, 2019 and titled Flavor Article for an Aerosol Delivery Device; U.S. patent application Ser. No. 15/935,105, filed on Mar. 26, 2018, and titled Aerosol Delivery Device Providing Flavor Control; and U.S. patent application Ser. No. 16/353,556, filed on Mar. 14, 2019, and titled Aerosol Delivery Device Providing Flavor Control, each of which is incorporated by reference herein in its entirety.

FIGS. 4-6 illustrate another example implementation of an aerosol device configured to receive a removable and replaceable cartridge. In particular, FIG. 4 illustrates a perspective view of an aerosol delivery device 400 shown in an open position, according to an example implementation of the present disclosure; FIG. 5 illustrates a perspective view of the aerosol delivery device 400 shown in a use position, according to an example implementation of the present invention; and FIG. 6 illustrates a longitudinal cross-section view of the aerosol delivery device 400 shown in a use position, according to one implementation of the present disclosure.

As shown in the figures, the aerosol delivery device 400 of the depicted implementation includes a holder 500 and removable and replaceable cartridge 300 (described in more detail below with respect to FIGS. 7 and 8). In the depicted implementation, the holder 500 generally comprises a main body 502 having a mouthend 503, and a rotating end portion 506. Although in some implementations the mouthend of the holder may be integral with the main body, in the depicted implementation the mouthend of the holder comprises a separate mouthpiece 504 that includes a mouthend portion 504*a,* which is located proximate a first end of the mouthpiece 504, and a collapsible portion 504*b,* which is located proximate a distal end of the mouthpiece 504. In the depicted implementation, the main body 502 is configured to be insertable into the mouthpiece 504. In other implementations, however, the mouthpiece may be configured to be insertable into the main body. In still other implementations, the main body and the mouthpiece may comprise an integral component such that the mouthpiece comprises a portion of the main body. In the depicted implementation, the main body 502 defines a first end 508 and an opposite distal end 510. The main body 502 of the depicted implementation further includes a receiving compartment 512 (see FIG. 3) located proximate the distal end 510 of the main body 502, and which is configured to receive at least a portion of the cartridge 300. The main body 502 of the depicted implementation further includes an aerosol passage 514 extending from the receiving compartment 512 to the mouthpiece 504. In the depicted implementation, the mouthpiece 504 also includes an aerosol passage 516. As such, when the main body 502 is inserted into mouthpiece 504, the aerosol passages 514, 516 substantially align.

As noted above, the mouthpiece 504 includes a collapsible portion 504*b*. In the depicted implementation, the collapsible portion 504*b* is configured to have two positions, an unlocked position, as shown, for example, in FIG. 4, and a locked position, as shown, for example, in FIGS. 5 and 6. In the unlocked position, the collapsible portion 504*b* is configured to extend outward and away from the mouthend portion 504*a,* such that the distal end of the mouthpiece 504 has a larger opening area than when the collapsible portion 504*b* is in the closed position. In the locked position, the collapsible portion 504*b* is configured to collapse around a portion of the periphery of an inserted main body 502, and, in some implementations, temporarily affix the mouthpiece 504 to the main body 504. In various implementations, the collapsible portion may achieve the two positions in a variety of different ways, including, for example, via one or more bi-stable spring features contained in or comprising the collapsible portion that are configured to have two equilibrium positions, one corresponding to the unlocked position and the other corresponding to the locked position. In such a manner, upon a force exerted by a user on the collapsible portion 504*b* of the depicted implementation (such as, for example, by lifting the collapsible portion 504*b* away from a longitudinal centerline of the mouthpiece 504) the collapsible portion 504*b* may be forced into the unlocked position, thus allowing the main body 502 to be inserted into the mouthpiece 504. Upon another force exerted by the user on the collapsible portion 504*b* (such as, for example, by pushing the collapsible portion 504*b* toward a longitudinal centerline of the mouthpiece 504), the collapsible portion 504*b* may be forced into the locked position. In some implementations, the mouthpiece and/or the main body may include additional features to facilitate temporarily affixing the mouthpiece and the main body together. For example, in some implementations an inner surface of the collapsible portion (or an outer surface of the main body) may include one or more protrusions, and an outer surface of the main body (or an inner surface of the collapsible portion) may include one or more corresponding detent features. Additionally or alternatively, in other implementations the collapsible portion and the main body may be temporarily affixed via one or more magnets. It should be noted that some implementations, the mouthpiece need not include a collapsible portion and the mouthpiece and the main body may be joined in other ways (such as those described above with respect to the implementation of FIGS. 1-3). As noted above, in still other implementations the mouthpiece and the main body may comprise an integral component.

In the depicted implementation, the holder 500 has a substantially rectangular shape, such as a substantially rectangular cuboid shape; however, in other implementations the holder may have a different shape. For example, in some implementations the holder may have a substantially cylindrical shape or a substantially oblong shape. In other implementations, the holder may have other hand-held shapes. For example, in some implementations the holder may have a small box shape, various pod mod shapes, or a fob-shape. In the depicted implementation, the holder 500 (when in a use position) has an overall length in an inclusive range of approximately 83 mm to approximately 120 mm, a width in the inclusive range of approximately 15 mm to approximately 25 mm, and a height in the inclusive range of approximately 8 mm to approximately 13 mm.

In various implementations, the holder, or various components or portions thereof (including, for example, the main body, the mouthpiece, and/or the rotating end portion), may be made of a variety of different materials. For example, in some implementations the holder (or one or more portions or components thereof) may be made of moldable plastic materials such as, for example, polycarbonate, polyethylene, acrylonitrile butadiene styrene (ABS), polyamide (Nylon), or polypropylene. In other implementations, however, the holder (or one or more portions or components thereof) may be made of a different material, such as, for example, a different plastic material, a metal material (such as, but not limited to, stainless steel, aluminum, brass, copper, silver, gold, or bronze), a graphite material, a glass material, a ceramic material, a natural material (such as, but not limited to, a wood material), a composite material, or any combinations thereof. In some implementations, the holder (or one or more portions or components thereof) may be made of the same material; however, in other implementations, the holder (or one or more portions or components thereof) may be made of different materials.

In various implementations of the present disclosure, the rotating end portion is configured to rotate to and from an open position, in which the rotating end portion is turned outward so as to provide access to the receiving compartment, and a use position, in which the rotating end portion is turned inward so as to cover (e.g., substantially fully cover) the heat source of an inserted cartridge. In the depicted implementation, for example, the rotating end portion 506 comprises a single end cover 506*a* pivotable about a hinge feature 507 between the end cover 506*a* and the main body 502. In the open position of the depicted implementation, the end cover 506*a* is configured to be rotated outward and away from the distal end 510 of the main body (see FIG. 1). In such a manner, a user may have access to insert into, and/or remove a cartridge from, the receiving compartment 512 of the main body 502. By contrast, in the use position (see FIGS. 2 and 3) the end cover 506*a* is configured to be rotated against the distal end 510 of the main body 502. In such a manner, the cartridge 300, and in particular the heat source 308, is substantially covered by the end cover 506*a* so as, for example, to protect the heat source 308 from accidental contact with a user.

In the depicted implementation, the rotating end portion 506 (and in particular, the end cover 506*a* ) further includes a plurality of openings 520 defined through the end portion 506. In such a manner, the openings 520 may provide the heat source 308 of an inserted cartridge 300 with sufficient exposure to air to remain ignited in the use position. In depicted implementation, the end cover 506*a* has a substantially flat, rounded rectangular overall shape. It should be noted that in other implementations, however, the end cover may have other configurations. For example, in some implementations the end cover may be substantially non-flat and/or may have a non-rectangular overall shape.

When in the use position, the end cover 506*a* of the depicted implementation is configured to cover the heat source 308 of an inserted cartridge 300. Although in some the end cover 506*a* may not include openings or may include less or more openings, in the depicted implementation the openings 520 are defined through a majority of the surface area of the end cover 506*a*. In the depicted implementation, the openings 520 have a substantially circular shape; however, in other implementations the openings may have any shape. As such, it will be appreciated that the rotating end portion can comprise fewer or additional openings and/or alternative shapes and sizes of openings than those illustrated.

In the depicted implementation, the rotating end portion 506 is configured to be rotated to and/or from the open and use positions via manual actuation by the user. In such a manner, a user of the depicted implementation may contact the rotating end portion 506 and flip the end cover 506*a* down (to effect the open position) or up (to effect the use position). In other implementations, the rotating end portion may include one or more features (such as, for example, one or more projections and/or other thumb or finger features) configured to assist a user in manually actuating the rotating end portion. In other implementations, the holder may include or more other actuating mechanisms, which are configured to rotate the rotating end portion to and/or from an open position and a use position. In various implementations, a variety of different actuating mechanisms may be used, which may or may not include one or more actuating buttons. Reference is made to the discussion of actuating mechanisms above, which will not be reproduced here.

In the depicted implementation, ignition of the heat source 308 results in aerosolization of the aerosol precursor composition associated with the substrate material 316. In the depicted implementation, the aerosol passage 514 of the main body 502 and the aerosol passage 516 of the mouthpiece 504 are configured to receive the generated aerosol therethrough in response to a draw applied to the mouthpiece 504 by a user. Although not shown, in some implementations the main body may include one or more supplemental air inlet openings that extend through the main body proximate the receiving compartment. Additionally or alternatively, other implementations may include one or more supplemental air inlet openings that extend through the main body and/or mouthpiece downstream from the receiving compartment. In such a manner, drawn air may mix with the generated aerosol before being delivered to the user. In some implementations, the outer housing of the cartridge may include apertures that substantially align with the supplemental air inlet openings such that air is drawn through the substrate portion. In other implementations, the outer housing of the cartridge may have sufficient porosity such that is drawn through the substrate portion.

In some implementations the main body and/or the mouthpiece may include a filter configured to receive the aerosol therethrough in response to the draw applied to the holder. In various implementations, the filter may be provided, in some aspects, as a circular disc radially and/or longitudinally disposed proximate the end of the holder (such as, for example, proximate the mouthpiece) opposite the receiving end. In this manner, upon a draw on the holder, the filter may receive the aerosol flowing through holder of the aerosol delivery device. In some implementations, the filter may comprise discrete segments. For example, some implementations may include a segment providing filtering, a segment providing draw resistance, a hollow segment providing a space for the aerosol to cool, other filter segments, and any one or any combination of the above. Preferably, the elements of the substrate material do not experience thermal decomposition (e.g., charring, scorching, or burning) to any significant degree, and the aerosolized components are entrained in the air drawn through the smoking article, including a filter (if present), and into the mouth of the user. In some implementations, the mouthpiece may include a filter that may also provide a flavorant additive. In some implementations, a filter may include one or more filter segments that may be replaceable. For example, in some implementations one or more filter segments may be replaceable in order to customize a user's experience with the device, including, for example, filter segments that provide different draw resistances and/or different flavors. Some examples of flavor adding materials and/or components configured to add a flavorant can be found in U.S. patent application Ser. No. 16/408,942, filed on May 10, 2019 and titled Flavor Article for an Aerosol Delivery Device; U.S. patent application Ser. No. 15/935,105, filed on Mar. 26, 2018, and titled Aerosol Delivery Device Providing Flavor Control; and U.S. patent application Ser. No. 16/353,556, filed on Mar. 14, 2019, and titled Aerosol Delivery Device Providing Flavor Control, each of which is incorporated by reference herein in its entirety.

FIG. 7 illustrates a perspective view of the removable and replaceable cartridge 300, according to an example implementation of the present disclosure. Other examples of cartridge configurations that may be applicable to the present disclosure can be found in U.S. patent application Ser. No. 16/515,637, filed on Jul. 18, 2019, and titled Aerosol Delivery Device with Consumable Cartridge, which is incorporated herein by reference in its entirety. In the depicted implementation, the cartridge 300 defines a first end 302 and a distal end 304. The cartridge 300 of the depicted implementation further includes a heat portion 306 comprising a heat source 308, a substrate portion 310 comprising a substrate material 316 (see FIG. 8), and an outer housing 312 configured to circumscribe at least a portion of the heat source 308 and substrate material 316. It should be noted that although in the depicted implementation the cartridge 300 has a substantially cylindrical overall shape, in various other implementations, the cartridge or any of its components may have a different shape. For example, in some implementations the cartridge (and/or any of its components) may have a substantially rectangular shape, such as a substantially rectangular cuboid shape. In other implementations, the cartridge (and/or any of its components) may have other hand-held shapes.

In some implementations a barrier may exist between the heat source and the substrate material. In some implementations, such a barrier may comprise a disc that may include one or more apertures therethrough. In some implementations, the barrier may be constructed of a metal material (such as, for example, stainless steel, aluminum, brass, copper, silver, gold, and bronze), or a graphite material, or a ceramic material, or a plastic material, or any combinations thereof. In some implementations, a heat transfer component, which may or may not comprise a barrier, may exist between the heat source and the substrate material. Some examples of heat transfer components are described in U.S. patent application Ser. No. 15/923,735, filed on Mar. 16, 2018, and titled Smoking Article with Heat Transfer Component, which is incorporated herein by reference in its entirety. In some implementations, a barrier and/or heat transfer component may prevent or inhibit combustion gasses from being drawn through the substrate material (and/or from being drawn through air passageways through which aerosol is drawn).

In various implementations, the heat source may be configured to generate heat upon ignition thereof. In the depicted implementation, the heat source 308 comprises a combustible fuel element that has a generally cylindrical shape and that incorporates a combustible carbonaceous material. In other implementations, the heat source may have a different shape, for example, a prism shape having a cubic or hexagonal cross-section. Carbonaceous materials generally have a high carbon content. Preferred carbonaceous materials are composed predominately of carbon, and/or typically have carbon contents of greater than about 60 percent, generally greater than about 70 percent, often greater than about 80 percent, and frequently greater than about 90 percent, on a dry weight basis.

In some instances, the heat source may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite a hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). In other implementations, the heat source may comprise a plurality of ignitable objects, such as, for example, a plurality of ignitable beads. It should be noted that in other implementations, the heat source may differ in composition or relative content amounts from those listed above. For example, in some implementations different forms of carbon could be used as a heat source, such as graphite or graphene. In other implementations, the heat source may have increased levels of activated carbon, different porosities of carbon, different amounts of carbon, blends of any above mentioned components, etc. In still other implementations, the heat source may comprise a non-carbon heat source, such as, for example, a combustible liquefied gas configured to generate heat upon ignition thereof. For example, in some implementations, the liquefied gas may comprise one or more of petroleum gas (LPG or LP-gas), propane, propylene, butylenes, butane, isobutene, methyl propane, or n-butane. In still other implementations, the heat source may comprise a chemical reaction based heat source, wherein ignition of the heat source comprises the interaction of two or more individual components. For example, a chemical reaction based heat source may comprise metallic agents and an activating solution, wherein the heat source is activated when the metallic agents and the activating solution come in contact. Some examples of chemical based heat sources can be found in U.S. Pat. No. 7,290,549 to Banerjee et al., which is incorporated herein by reference in its entirety. Combinations of heat sources are also possible.

Although specific dimensions of an applicable heat source may vary, in the depicted implementation, the heat source 308 has a length in an inclusive range of approximately 5 mm to approximately 20 mm, and in some implementations may be approximately 12 mm, and an overall diameter in an inclusive range of approximately 3 mm to approximately 8 mm, and in some implementations may be approximately 4.8 mm (and in some implementations, approximately 7 mm).

Although in other implementations, the heat source may be constructed in a variety of ways, in the depicted implementation, the heat source 308 is extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties.

Although in various implementations the heat source may have a variety of forms, including, for example, a substantially solid cylindrical shape or a hollow cylindrical (e.g., tube) shape, the heat source 308 of the depicted implementation comprises an extruded monolithic carbonaceous material that has a generally cylindrical shape that includes a plurality of internal passages 314 extending longitudinally from a first end of the heat source 308 to an opposing second end of the heat source 308. In the depicted implementation there are approximately thirteen internal passages 314 comprising a single central internal passage 314*a*, six surrounding internal passages 314*b*, which are spaced from the central internal passages 314*a* and have a similar size (e.g., diameter) to that of the central internal passage 314*a*, and six peripheral internal passages 314*c*, which are spaced from an outer surface of the heat source 308 and are smaller in diameter than that of the central internal passage 314*a*. It should be noted that in other implementations, there need not be a plurality of internal passages and/or the plurality of internal passages may take other forms and/or sizes. For example, in some implementations, there may be as few as two internal passages, and still other implementations may include as few as a single internal passage. Still other implementations may include no internal passages at all. Additional implementations may include multiple internal passages that may be of unequal diameter and/or shape and which may be unequally spaced and/or located within the heat source.

Some implementations may alternatively, or additionally include one or more peripheral grooves that extend longitudinally from a first end of the heat source to an opposing second end, although in other implementations the grooves need not extend the full length of the heat source. In some implementations, such grooves may be substantially equal in width and depth and may be substantially equally distributed about a circumference of the heat source. In such implementations, there may be as few as two grooves, and still other implementations may include as few as a single groove. Still other implementations may include no grooves at all. Additional implementations may include multiple grooves that may be of unequal width and/or depth, and which may be unequally spaced around a circumference of the heat source. In still other implementations, the heat source may include flutes and/or slits extending longitudinally from a first end of the extruded monolithic carbonaceous material to an opposing second end thereof. In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source implementations such as is disclosed in U.S. Pat. App. Pub. No. 2009/0044818 to Takeuchi et al., each of which is incorporated herein by reference in its entirety. Further examples of heat sources including debossed heat source systems, methods, and smoking articles that include such heat sources are disclosed in U.S. patent application Ser. No. 15/902,665, filed on Feb. 22, 2018, and titled System for Debossing a Heat Generation Member, a Smoking Article Including the Debossed Heat Generation Member, and a Related Method, which is incorporated herein by reference in its entirety.

Generally, the heat source is positioned sufficiently near an aerosol delivery component (e.g., the substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

FIG. 8 illustrates a longitudinal cross-section view of the cartridge 300 of FIG. 7. As shown in the figure, the substrate material 316 of the depicted implementation has opposed first and second ends, with the heat source 308 disposed adjacent the first end of the substrate material 316. Although dimensions of the various components of the cartridge may vary due to the needs of a particular application, in the depicted implementation the cartridge 300 may have an overall length in an inclusive range of approximately 10 mm to approximately 50 mm and a diameter in an inclusive range of approximately 2 mm to approximately 20 mm. In addition, in the depicted implementation the outer housing 312 may have a thickness in the inclusive range of approximately 0.05 mm to 0.5 mm. Furthermore, in the depicted implementation the substrate material 116 may have a length in the inclusive range of approximately 5 mm to 30 mm and a diameter slightly less than that of the overall cartridge in order to accommodate the thickness of the housing 112, such as, for example, a diameter in an inclusive range of approximately 2.9 mm to approximately 9.9 mm.

In the depicted implementation, the substrate portion 310 comprises a substrate material 316 having a single segment, although in other implementations the substrate portion may include one or more additional substrate material segments. For example in some implementations, the aerosol delivery device may further comprise a second substrate material segment (not shown) having opposed first and second ends. In various implementations, one or more of the substrate materials may include a tobacco or tobacco related material, with an aerosol precursor composition associated therewith. In other implementations, non-tobacco materials may be used, such as a cellulose pulp material. In other implementations, the non-tobacco substrate material may not be a plant-derived material. Other possible compositions, components, and/or additives for use in a substrate material (and/or substrate materials) are described in more detail below. It should be noted that the subsequent discussion should be applicable any substrate material usable in the smoking articles described herein (such as, for example, the substrate material of the depicted implementations).

In one implementation, for example, the substrate material may comprise a blend of flavorful and aromatic tobaccos in cut filler form. In another implementation, the substrate material may comprise a reconstituted tobacco material, such as described in U.S. Pat. No. 4,807,809 to Pryor et al.; U.S. Pat. No. 4,889,143 to Pryor et al. and U.S. Pat. No. 5,025,814 to Raker, the disclosures of which are incorporated herein by reference in their entirety. Additionally, a reconstituted tobacco material may include a reconstituted tobacco paper for the type of cigarettes described in Chemical and Biological Studies on New Cigarette Prototypes that Heat Instead of Burn Tobacco, R. J. Reynolds Tobacco Company Monograph (1988), the contents of which are incorporated herein by reference in its entirety. For example, a reconstituted tobacco material may include a sheet-like material containing tobacco and/or tobacco-related materials. As such, in some implementations, the substrate material may be formed from a wound roll of a reconstituted tobacco material. In another implementation, the substrate material may be formed from shreds, strips, and/or the like of a reconstituted tobacco material. In another implementation, the tobacco sheet may comprise overlapping layers (e.g., a gathered web), which may, or may not, include heat conducting constituents. Examples of substrate portions that include a series of overlapping layers (e.g., gathered webs) of an initial substrate sheet formed by the fibrous filler material, aerosol forming material, and plurality of heat conducting constituents are described in U.S. patent application Ser. No. 15/905,320, filed on Feb. 26, 2018, and titled Heat Conducting Substrate For Electrically Heated Aerosol Delivery Device, which is incorporated herein by reference in its entirety.

In some implementations, the substrate material may include a plurality of microcapsules, beads, granules, and/or the like having a tobacco-related material. For example, a representative microcapsule may be generally spherical in shape, and may have an outer cover or shell that contains a liquid center region of a tobacco-derived extract and/or the like. In some implementations, one or more of the substrate materials may include a plurality of microcapsules each formed into a hollow cylindrical shape. In some implementations, one or more of the substrate materials may include a binder material configured to maintain the structural shape and/or integrity of the plurality of microcapsules formed into the hollow cylindrical shape.

Tobacco employed in one or more of the substrate materials may include, or may be derived from, tobaccos such as flue-cured tobacco, burley tobacco, Oriental tobacco, Maryland tobacco, dark tobacco, dark-fired tobacco and Rustica tobacco, as well as other rare or specialty tobaccos, or blends thereof. Various representative tobacco types, processed types of tobaccos, and types of tobacco blends are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; U.S. Pat. No. 6,701,936 to Shafer et al.; U.S. Pat. No. 6,730,832 to Dominguez et al.; U.S. Pat. No. 7,011,096 to Li et al.; U.S. Pat. No. 7,017,585 to Li et al.; U.S. Pat. No. 7,025,066 to Lawson et al.; U.S. Pat. App. Pub. No. 2004/0255965 to Perfetti et al.; PCT Pub. No. WO 02/37990 to Bereman; and Bombick et al., *Fund. Appl. Toxicol.,* 39, p. 11-17 (1997); the disclosures of which are incorporated herein by reference in their entireties.

In still other implementations of the present disclosure, the substrate material may include an extruded structure that includes, or is essentially comprised of a tobacco, a tobacco related material, glycerin, water, and/or a binder material, although certain formulations may exclude the binder material. In various implementations, suitable binder materials may include alginates, such as ammonium alginate, propylene glycol alginate, potassium alginate, and sodium alginate. Alginates, and particularly high viscosity alginates, may be employed in conjunction with controlled levels of free calcium ions. Other suitable binder materials include hydroxypropylcellulose such as Klucel H from Aqualon Co.; hydroxypropylmethylcellulose such as Methocel K4MS from The Dow Chemical Co.; hydroxyethylcellulose such as Natrosol 250 MRCS from Aqualon Co.; microcrystalline cellulose such as Avicel from FMC; methylcellulose such as Methocel A4M from The Dow Chemical Co.; and sodium carboxymethyl cellulose such as CMC 7HF and CMC 7H4F from Hercules Inc. Still other possible binder materials include starches (e.g., corn starch), guar gum, carrageenan, locust bean gum, pectins and xanthan gum. In some implementations, combinations or blends of two or more binder materials may be employed. Other examples of binder materials are described, for example, in U.S. Pat. No. 5,101,839 to Jakob et al.; and U.S. Pat. No. 4,924,887 to Raker et al., each of which is incorporated herein by reference in its entirety. In some implementations, the aerosol forming material may be provided as a portion of the binder material (e.g., propylene glycol alginate). In addition, in some implementations, the binder material may comprise nanocellulose derived from a tobacco or other biomass.

In some implementations, the substrate material may include an extruded material, as described in U.S. Pat. App. Pub. No. 2012/0042885 to Stone et al., which is incorporated herein by reference in its entirety. In yet another implementation, the substrate material may include an extruded structure and/or substrate formed from marumarized and/or non-marumarized tobacco. Marumarized tobacco is known, for example, from U.S. Pat. No. 5,105,831 to Banerjee, et al., which is incorporated by reference herein in its entirety. Marumarized tobacco includes about 20 to about 50 percent (by weight) tobacco blend in powder form, with glycerol (at about 20 to about 30 percent weight), calcium carbonate (generally at about 10 to about 60 percent by weight, often at about 40 to about 60 percent by weight), along with binder agents, as described herein, and/or flavoring agents. In various implementations, the extruded material may have one or more longitudinal openings.

In various implementations, the substrate material may take on a variety of conformations based upon the various amounts of materials utilized therein. For example, a sample substrate material may comprise up to approximately 98% by weight, up to approximately 95% by weight, or up to approximately 90% by weight of a tobacco and/or tobacco related material. A sample substrate material may also comprise up to approximately 25% by weight, approximately 20% by weight, or approximately 15% by weight water—particularly approximately 2% to approximately 25%, approximately 5% to approximately 20%, or approximately 7% to approximately 15% by weight water. Flavors and the like (which include, for example, medicaments, such as nicotine) may comprise up to approximately 10%, up to about 8%, or up to about 5% by weight of the aerosol delivery component.

Additionally or alternatively, the substrate material may include an extruded structure and/or a substrate that includes or essentially is comprised of tobacco, glycerin, water, and/or binder material, and is further configured to substantially maintain its structure throughout the aerosol-generating process. That is, the substrate material may be configured to substantially maintain its shape (e.g., the substrate material does not continually deform under an applied shear stress) throughout the aerosol-generating process. Although such an example substrate material may include liquids and/or some moisture content, the substrate may remain substantially solid throughout the aerosol-generating process and may substantially maintain structural integrity throughout the aerosol-generating process. Example tobacco and/or tobacco related materials suitable for a substantially solid substrate material are described in U.S. Pat. App. Pub. No. 2015/0157052 to Ademe et al.; U.S. Pat. App. Pub. No. 2015/0335070 to Sears et al.; U.S. Pat. No. 6,204,287 to White; and U.S. Pat. No. 5,060,676 to Hearn et al., which are incorporated herein by reference in their entirety.

In some implementations, the amount of substrate material used within the smoking article may be such that the article exhibits acceptable sensory and organoleptic properties, and desirable performance characteristics. For example, in some implementations an aerosol precursor composition such as, for example, glycerin and/or propylene glycol, may be employed within the substrate material in order to provide for the generation of a visible mainstream aerosol that in many regards resembles the appearance of tobacco smoke. For example, the amount of aerosol precursor composition incorporated into the substrate material of the smoking article may be in the range of about 3.5 grams or less, about 3 grams or less, about 2.5 grams or less, about 2 grams or less, about 1.5 grams or less, about 1 gram or less, or about 0.5 gram or less.

According to another implementation, a smoking article according to the present disclosure may include a substrate material comprising a porous, inert material such as, for example, a ceramic material. For example, in some implementations ceramics of various shapes and geometries (e.g., beads, rods, tubes, etc.) may be used, which have various pore morphology. In addition, in some implementations non-tobacco materials, such as an aerosol precursor composition, may be loaded into the ceramics. In another implementation, the substrate material may include a porous, inert material that does not substantially react, chemically and/or physically, with a tobacco-related material such as, for example, a tobacco-derived extract. In addition, an extruded tobacco, such as those described above, may be porous. For example, in some implementations an extruded tobacco material may have an inert gas, such as, for example, nitrogen, that acts as a blowing agent during the extrusion process.

As noted above, in various implementations one or more of the substrate materials may include a tobacco, a tobacco component, and/or a tobacco-derived material that has been treated, manufactured, produced, and/or processed to incorporate an aerosol precursor composition (e.g., humectants such as, for example, propylene glycol, glycerin, and/or the like) and/or at least one flavoring agent, as well as a flame/burn retardant (e.g., diammonium phosphate and/or another salt) configured to help prevent ignition, pyrolysis, combustion, and/or scorching of the substrate material by the heat source. Various manners and methods for incorporating tobacco into smoking articles, and particularly smoking articles that are designed so as to not purposefully burn virtually all of the tobacco within those smoking articles are set forth in U.S. Pat. No. 4,947,874 to Brooks et al.; U.S. Pat. No. 7,647,932 to Cantrell et al.; U.S. Pat. No. 8,079,371 to Robinson et al.; U.S. Pat. No. 7,290,549 to Banerjee et al.; and U.S. Pat. App. Pub. No. 2007/0215167 to Crooks et al.; the disclosures of which are incorporated herein by reference in their entireties.

As noted, in some implementations, flame/burn retardant materials and other additives that may be included within one or more of the substrate materials and may include organo-phosophorus compounds, borax, hydrated alumina, graphite, potassium tripolyphosphate, dipentaerythritol, pentaerythritol, and polyols. Others such as nitrogenous phosphonic acid salts, mono-ammonium phosphate, ammonium polyphosphate, ammonium bromide, ammonium borate, ethanolammonium borate, ammonium sulphamate, halogenated organic compounds, thiourea, and antimony oxides are suitable but are not preferred agents. In each aspect of flame-retardant, burn-retardant, and/or scorch-retardant materials used in the substrate material and/or other components (whether alone or in combination with each other and/or other materials), the desirable properties most preferably are provided without undesirable off-gassing or melting-type behavior.

According to other implementations of the present disclosure, the substrate material may also incorporate tobacco additives of the type that are traditionally used for the manufacture of tobacco products. Those additives may include the types of materials used to enhance the flavor and aroma of tobaccos used for the production of cigars, cigarettes, pipes, and the like. For example, those additives may include various cigarette casing and/or top dressing components. See, for example, U.S. Pat. No. 3,419,015 to Wochnowski; U.S. Pat. No. 4,054,145 to Berndt et al.; U.S. Pat. No. 4,887,619 to Burcham, Jr. et al.; U.S. Pat. No. 5,022,416 to Watson; U.S. Pat. No. 5,103,842 to Strang et al.; and U.S. Pat. No. 5,711,320 to Martin; the disclosures of which are incorporated herein by reference in their entireties. Preferred casing materials may include water, sugars and syrups (e.g., sucrose, glucose and high fructose corn syrup), humectants (e.g. glycerin or propylene glycol), and flavoring agents (e.g., cocoa and licorice). Those added components may also include top dressing materials (e.g., flavoring materials, such as menthol). See, for example, U.S. Pat. No. 4,449,541 to Mays et al., the disclosure of which is incorporated herein by reference in its entirety. Further materials that may be added include those disclosed in U.S. Pat. No. 4,830,028 to Lawson et al. and U.S. Pat. No. 8,186,360 to Marshall et al., the disclosures of which are incorporated herein by reference in their entireties.

In some implementations, the substrate material may comprise a liquid including an aerosol precursor composition and/or a gel including an aerosol precursor composition. Some examples of liquid compositions can be found in U.S. patent application Ser. No. 16/171,920, filed on Oct. 26, 2018, and titled Aerosol Delivery Device With Visible Indicator, which is incorporated herein by reference in its entirety.

As noted above, in various implementations, one or more of the substrate materials may have an aerosol precursor composition associated therewith. For example, in some implementations the aerosol precursor composition may comprise one or more different components, such as polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. In some aspects, a substrate material may produce a visible aerosol upon the application of sufficient heat thereto (and cooling with air, if necessary), and the substrate material may produce an aerosol that is "smoke-like." In other aspects, the substrate material may produce an aerosol that is substantially non-visible but is recognized as present by other characteristics, such as flavor or texture. Thus, the nature of the produced aerosol may be variable depending upon the specific components of the aerosol delivery component. The aerosol may be chemically simple relative to the chemical nature of the smoke produced by burning tobacco.

In some implementations, the aerosol precursor composition may incorporate nicotine, which may be present in various concentrations. The source of nicotine may vary, and the nicotine incorporated in the aerosol precursor composition may derive from a single source or a combination of two or more sources. For example, in some implementations the aerosol precursor composition may include nicotine derived from tobacco. In other implementations, the aerosol precursor composition may include nicotine derived from other organic plant sources, such as, for example, non-tobacco plant sources including plants in the Solanaceae family. In other implementations, the aerosol precursor composition may include synthetic nicotine. In some implementations, nicotine incorporated in the aerosol precursor composition may be derived from non-tobacco plant sources, such as other members of the Solanaceae family. The aerosol precursor composition may additionally or alternatively include other active ingredients including, but not limited to, botanical ingredients (e.g., lavender, peppermint, chamomile, basil, rosemary, thyme, eucalyptus, ginger, cannabis, ginseng, maca, and tisanes), stimulants (e.g., caffeine and guarana), amino acids (e.g., taurine, theanine, phenylalanine, tyrosine, and tryptophan) and/or pharmaceutical, nutraceutical, and medicinal ingredients (e.g., vitamins, such as B6, B12, and C and cannabinoids, such as tetrahydrocannabinol (THC) and cannabidiol (CBD)).

A wide variety of types of flavoring agents, or materials that alter the sensory or organoleptic character or nature of the mainstream aerosol of the smoking article may be suitable to be employed. In some implementations, such flavoring agents may be provided from sources other than tobacco and may be natural or artificial in nature. For example, some flavoring agents may be applied to, or incorporated within, the substrate material and/or those regions of the smoking article where an aerosol is generated. In some implementations, such agents may be supplied directly to a heating cavity or region proximate to the heat source or are provided with the substrate material. Example flavoring agents may include, for example, vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, may also be suitable to be employed.

Flavoring agents may also include acidic or basic characteristics (e.g., organic acids, such as levulinic acid, succinic acid, pyruvic acid, and benzoic acid). In some implementations, flavoring agents may be combinable with the elements of the substrate material if desired. Example plant-derived compositions that may be suitable are disclosed in U.S. Pat. No. 9,107,453 and U.S. Pat. App. Pub. No. 2012/0152265 both to Dube et al., the disclosures of which are incorporated herein by reference in their entireties. Any of the materials, such as flavorings, casings, and the like that may be useful in combination with a tobacco material to affect sensory properties thereof, including organoleptic properties, such as described herein, may be combined with the substrate material. Organic acids particularly may be able to be incorporated into the substrate material to affect the flavor, sensation, or organoleptic properties of medicaments, such as nicotine, that may be able to be combined with the substrate material.

For example, organic acids, such as levulinic acid, lactic acid, pyruvic acid, and benzoic acid may be included in the substrate material with nicotine in amounts up to being equimolar (based on total organic acid content) with the nicotine. Any combination of organic acids may be suitable. For example, in some implementations, the substrate material may include approximately 0.1 to about 0.5 moles of levulinic acid per one mole of nicotine, approximately 0.1 to about 0.5 moles of pyruvic acid per one mole of nicotine, approximately 0.1 to about 0.5 moles of lactic acid per one mole of nicotine, or combinations thereof, up to a concentration wherein the total amount of organic acid present is equimolar to the total amount of nicotine present in the substrate material. Various additional examples of organic acids employed to produce a substrate material are described in U.S. Pat. App. Pub. No. 2015/0344456 to Dull et al., which is incorporated herein by reference in its entirety.

The selection of such further components may be variable based upon factors such as the sensory characteristics that are desired for the smoking article, and the present disclosure is intended to encompass any such further components that are readily apparent to those skilled in the art of tobacco and tobacco-related or tobacco-derived products. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties.

In other implementations, the substrate material may include other materials having a variety of inherent characteristics or properties. For example, the substrate material may include a plasticized material or regenerated cellulose in the form of rayon. As another example, viscose (commercially available as VISIL®), which is a regenerated cellulose product incorporating silica, may be suitable. Some carbon fibers may include at least 95 percent carbon or more. Similarly, natural cellulose fibers such as cotton may be suitable, and may be infused or otherwise treated with silica, carbon, or metallic particles to enhance flame-retardant properties and minimize off-gassing, particularly of any undesirable off-gassing components that would have a negative impact on flavor (and especially minimizing the likelihood of any toxic off-gassing products). Cotton may be treatable with, for example, boric acid or various organophosphate compounds to provide desirable flame-retardant properties by dipping, spraying or other techniques known in the art. These fibers may also be treatable (coated, infused, or both by, e.g., dipping, spraying, or vapor-deposition) with organic or metallic nanoparticles to confer the desired property of flame-retardancy without undesirable off-gassing or melting-type behavior.

In the depicted implementation, the substrate material 316 may comprise a centrally defined longitudinally extending axis between the opposed first and second ends, and a cross-section of the substrate material 316 may be, in some implementations, symmetrical about the axis. For example, in some implementations a cross-section of the substrate material may be substantially circular such that the substrate material defines a substantially cylindrical shape extending between the opposed first and second ends thereof. However, in other implementations, the substrate material may define a substantially non-circular cross-section such that the substrate material may define a substantially non-cylindrical shape between the opposed first and second ends thereof. Otherwise, in other examples, the substrate material may comprise an asymmetric cross-section about the axis. In various implementations, each end of the substrate material may be in axial alignment with adjacent elements.

As shown in FIGS. 7 and 8, the outer housing 312 of the cartridge 300 of the depicted implementation is configured to circumscribe at least a portion of the substrate portion 310, including the substrate material 316. In the depicted implementation, the outer housing 312 is also configured to circumscribe at least a portion of the heat source 308. In some implementations, the outer housing may circumscribe the entire heat source. In the depicted implementation, the outer housing comprises a rigid material. For example, the outer housing 312 of the depicted implementation is constructed of an aluminum material; however, in other implementations the outer housing may be constructed of other materials, including other metal materials (such as, for example, stainless steel, aluminum, brass, copper, silver, gold, and bronze), or graphite materials, or ceramic materials, or plastic materials, or any combinations thereof. In some implementations, at least a portion of the heat source and/or at least a portion of the substrate material may be circumscribed by a paper foil laminate. Some examples of laminates that may be applicable to the present disclosure can be found in U.S. patent application Ser. No. 16/174,846, filed on Oct. 30, 2018, and titled Smoking Article Cartridge, which is incorporated herein by reference in its entirety.

In the depicted implementation, the outer housing 312 is constructed as tube structure that substantially encapsulates the substrate material 316; however, as noted above, in other implementations the outer housing may have other shapes. Although the shape of the outer housing may vary, in the depicted implementation the outer housing 312 comprises a tube structure having an open end and a closed end. The depicted implementation of the outer housing 312 also includes one or more end apertures 318 located on the closed end of the outer housing 112 that are configured to allow aerosolized vapor (herein alternatively referred to as a "vapor" or "aerosol") to pass therethrough. The end apertures 318 of the depicted implementation are in the form of a pair of elongate rounded slots; however, in other implementations the end apertures may have any form that permits passage of the aerosol therethrough. As such, it will be appreciated that the end apertures 118 can comprise fewer or additional apertures and/or alternative shapes and sizes of apertures than those illustrated.

As noted above, in various implementations of the present disclosure the rotating end portion is configured to move to and from an open position and a use position. In various implementations, the open position of the rotating end portion is configured to allow a user to insert and remove a cartridge from the main body. In order to move from the open position to the use position (or vice versa), the rotating end portion is rotated, either manually or via an actuating mechanism. In the use position, the cartridge is substantially protected while providing the heat source with sufficient exposure to air to remain ignited. In such a manner, the present disclosure provides a convenient and easy to use holder that may be used with one or more removable and replaceable cartridges.

In various implementations, the present disclosure may be directed to kits that provide a variety of components as described herein. For example, a kit may comprise a holder with one or more cartridges. In another implementation, a kit may comprise a plurality of holders. In further implementations, a kit may comprise a plurality of cartridges. In yet another implementation, a kit may comprise a plurality of holders and a plurality of cartridges. The inventive kits may further include a case (or other packaging, carrying, or storage component) that accommodates one or more of the further kit components. The case could be a reusable hard or soft container. Further, the case could be simply a box or other packaging structure. In some implementations, a brush or other cleanout accessory may be included in a kit. The cleanout accessory may be configured to be inserted in a receiving chamber of the holder, or, in other implementations, inserted in a separate aperture that enables a user to remove debris from the receiving chamber.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. An aerosol delivery device comprising:

a holder comprising a main body having a mouthend and a rotating end portion;

a removable cartridge comprising a heat portion including a heat source configured to generate heat, and a substrate portion disposed proximate the heat source, the substrate portion comprising a substrate material including an aerosol precursor composition, wherein the main body defines a receiving compartment configured to receive at least a portion of the cartridge proximate a distal end of the main body, wherein the main body further defines an aerosol passage extending from the receiving compartment through the mouthend, wherein the rotating end portion is configured to rotate proximate an end of the holder opposite the mouthend to and from an open position, in which the rotating end portion is turned outward so as to provide access to the receiving compartment, and a use position, in which the rotating end portion is turned inward so as to cover the heat source of an inserted cartridge, and wherein the rotating end portion comprises a plurality of openings defined therethrough, the openings configured to provide the heat source with exposure to air.

2. The aerosol delivery device of claim 1, wherein the rotating end portion comprises a single end cover.

3. The aerosol delivery device of claim 1, wherein the rotating end portion comprises first and second opposing end covers.

4. The aerosol delivery device of claim 3, wherein the first and second opposing end covers define respective distal ends, and wherein in the open position the distal ends of the first and second end covers are configured to be rotated outward and away from each other, and in the use position the distal ends of the first and second end covers are configured to be rotated inward and proximate each other.

5. The aerosol delivery device of claim 1, wherein the holder further comprises an actuating mechanism configured to rotate the rotating end portion.

6. The aerosol delivery device of claim 5, wherein the actuating mechanism is configured to rotate the rotating end portion from the use position to the open position.

7. The aerosol delivery device of claim 5, wherein the actuating mechanism is configured to rotate the rotating end portion from the open position to the use position.

8. The aerosol delivery device of claim 5, wherein the actuating mechanism includes one or more buttons located on the main body of the device.

9. The aerosol delivery device of claim 1, wherein the mouthend comprises a separate mouthpiece configured to be insertable into the main body.

10. The aerosol delivery device of claim 1, wherein the mouthend comprises a separate mouthpiece, wherein the main body is configured to be insertable into the mouthpiece, and wherein the mouthpiece includes a collapsible portion configured to lock the mouthpiece and the main body together.

11. A holder for use with a removable and replaceable substrate cartridge that includes a heat source, the holder comprising:

a main body having a mouthend; and a rotating end portion, wherein the main body defines a receiving compartment configured to receive at least a portion of the cartridge proximate a distal end of the main body, wherein the main body further defines an aerosol passage extending from the receiving compartment through the mouthend, wherein the rotating end portion is configured to rotate proximate an end of the holder opposite the mouthend to and from an open position, in which the rotating end portion is turned outward so as to provide access to the receiving compartment, and a use position, in which the rotating end portion is turned inward so as to cover the heat source of an inserted cartridge, and wherein the rotating end portion comprises a plurality of openings defined therethrough, the openings configured to provide the heat source with exposure to air.

12. The holder of claim 11, wherein the rotating end portion comprises a single end cover.

13. The holder of claim 11, wherein the rotating end portion comprises first and second opposing end covers.

14. The holder of claim 13, wherein the first and second opposing end covers define respective distal ends, and wherein in the open position the distal ends of the first and second end covers are configured to be rotated outward and away from each other, and in the use position the distal ends of the first and second end covers are configured to be rotated inward and proximate each other.

15. The holder of claim 11 further comprising an actuating mechanism configured to rotate the rotating end portion.

16. The holder of claim 15, wherein the actuating mechanism is configured to rotate the rotating end portion from the use position to the open position.

17. The holder of claim 15, wherein the actuating mechanism is configured to rotate the rotating end portion from the open position to the use position.

18. The holder of claim 15, wherein the actuating mechanism includes one or more buttons located on the main body of the device.

19. The holder of claim 11, wherein the mouthend comprises a separate mouthpiece configured to be insertable into the main body.

20. The holder of claim 11, wherein the mouthend comprises a separate mouthpiece, wherein the main body is configured to be insertable into the mouthpiece, and wherein the mouthpiece is configured to have two positions, an unlocked position and a locked position.

* * * * *